US005803761A

United States Patent [19]

Mochizuki

[11] Patent Number: 5,803,761

[45] Date of Patent: Sep. 8, 1998

[54] EDGE CONNECTOR

[75] Inventor: Shoichi Mochizuki, Tokyo, Japan

[73] Assignee: Kel Corporation, Tokyo, Japan

[21] Appl. No.: 847,312

[22] Filed: Apr. 24, 1997

[30] Foreign Application Priority Data

Apr. 30, 1996 [JP] Japan ..... 8-109560

[51] Int. Cl.[6] ..... H01R 13/62

[52] U.S. Cl. ..... 439/326

[58] Field of Search ..... 439/325, 326, 439/327, 328, 629, 630

[56] References Cited

U.S. PATENT DOCUMENTS 5,267,872 12/1993 Gou et al. ..... 439/326
5,389,000 2/1995 Diviesti ..... 439/157
5,690,502 11/1997 Mochizuki ..... 439/326 X
5,695,354 12/1997 Noda ..... 439/326

*Primary Examiner*—Khiem Nguyen
*Attorney, Agent, or Firm*—Robert W. J. Usher

[57] ABSTRACT

A latch member (50) having an engagement section (54) and an abutment section (55) at its rear end portion is formed by a metal material and is secured to a housing (2) at its front end portion so as to freely swing between an engagement position for engaging and holding a memory module and a release position for releasing the memory module from being engaged and held. When a release lever (25), which is integrally formed with the housing (2) and engages the latch member (50), is opened outward so as to remove the memory module, the abutment section (55) abuts to a stopper (27) so that the engagement section (54) is positioned at the release position.

6 Claims, 6 Drawing Sheets

EDGE CONNECTOR

BACKGROUND OF THE INVENTION

1. Field of the Invention

The present invention relates to an edge connector used for implementing a substrate (sub-board) having a plurality of conductive pads at its tip portion, such as a memory module, onto a surface of another substrate (main board).

2. Prior Art

In general, an edge connector accommodates an end portion of a sub-board, which is known as memory module or the like, and is disposed on a main board in order to electrically connect the sub-board to the main board. The edge connector is constituted such that a plurality of contacts to be soldered onto the main board are arranged in a housing made of a resin material (insulating material) such as plastic. When the sub-board is inserted into the edge connector, these contacts and leads (conductive pads) printed on the sub-board come into contact with each other, whereby the sub-board and the main board are electrically connected to each other by way of the edge connector soldered onto the main board.

In order to facilitate replacement of memory modules or the like to be implemented and to reduce the space occupied after the attachment, known is an edge connector of a type in which a sub-board inserted from obliquely thereabove is secured and held in parallel with the main board. In general, such an edge connector has arms at both ends of the housing body. When the sub-board is attached to the edge connector, between a plurality of contacts aligned in upper and lower rows within an accommodating space formed in the housing body, one end side of the sub-board is inserted (at which the sub-board is held at a position where the sub-board is raised obliquely upward with respect to the edge connector, referred to as "raised position" hereinafter) and then is pushed down to a position in parallel with the main board (referred to as "implementation position" hereinafter) so as to be mounted on and held by the arms.

Here, in general, in the edge connector of this type, in order to secure and hold the sub-board at the implementation position, each of the right and left arms is provided with a latch having an engagement section projecting inwardly and obliquely downward as lock means. When the sub-board is pushed down against the resilient forces of the contacts, the upper face of the engagement section comes into contact with the descending edge portion of the sub-board, whereby the latch is pushed open. Consequently, while pushing the latch open, the sub-board is pushed down to the implementation position below the latch. At the implementation position, the sub-board is positioned below the engagement section, whereby the engagement section is released from spreading outward. Accordingly, the engagement section returns to the initial position so as to project to the upper side of the sub-board, thereby preventing the sub-board from returning to the raised position. Thus, the sub-board is held at the implementation position while electrically connecting with the main board.

Also, in order to release the engagement section when removing the sub-board, the latch is provided with a release lever which is adapted to engage the engagement section so as to outwardly move the latter in the right or left direction. When replacing the sub-board, the release lever is spread by fingers in the right or left direction. Consequently, the engagement section engaged with the release lever is moved outward in the right or left direction, thereby releasing the sub-board from being engaged and held. Thus, the sub-board returns to the raised position due to the resilient forces of the contacts. Accordingly, the sub-board can be picked up and removed by fingers.

Since it is necessary for the edge connector to occupy a space as little as possible when disposed on the main board, the right and left arms thereof are formed thin. Accordingly, in the latch (lock means), the engagement section is made of a metal so as to yield a durability and strength sufficient for securing and holding the sub-board, which is repeatedly inserted therein and detached therefrom, whereas the release lever is integrally formed with the housing body by a resin such that it can elastically open outward in the right or left direction.

While the release lever is opened outward in the right or left direction for replacing the sub-board, it is hard to judge how wide the release lever should be opened by fingers to reach a predetermined release position. Namely, it may be opened too narrow or too wide. Thus, the operability in this releasing operation may be unfavorable.

Also, as the release lever is repeatedly operated, the engagement section or release lever may be broken or permanently deformed when the release lever is inadvertently opened in excess of its tolerant range.

SUMMARY OF THE INVENTION

In order to overcome these problems, it is an object of the present invention to provide an edge connector with security and favorable operability, in which no damage is inadvertently generated when its release lever is operated in order to remove the sub-board engaged and held therewith.

In order to attain the above object, the edge connector of the present invention comprises a housing formed by a resin material, having a main body, and arms respectively extending rearward from right and left ends of the main body; a plurality of contacts arranged within an accommodating space formed in the main body of the housing; and lock means for releasably holding a substrate to be implemented. The lock means is constituted by an engagement member made of a metal material; a release lever for releasing the engagement of the substrate, formed so as to be able to engage the engagement member; and a stopper with which the engagement member comes into contact. Here, the release lever and the stopper are integrally formed with the housing by the resin material.

When the end portion of the substrate where conductive pads are arranged is inserted into the accommodating space of the edge connector, the contacts of the edge connector and the conductive pads come into contact with each other. In this state, however, the electric connection between the substrate and the edge connector is not secure, and it cannot be considered that all the contacts and conductive pads are in contact with each other. Accordingly, in order to cause the contacts to elastically deform so as to establish a press contact state between the contacts and conductive pads, thereby securing the electric connection, the substrate is pushed down from the inserted state (raised position) to a parallel state (implementation position) along the arms.

Here, the engagement member of the lock means engages and holds the substrate that has reached the implementation position. Since the engagement member is attached to the housing, it is freely movable, due to elastic deformation, between the engagement position for engaging and holding the substrate and the release position for releasing the substrate from being engaged and held. When the substrate is pushed down, the engagement member is temporarily moved to the release position as being pushed by the end portion of the substrate abutting thereto. Thereafter, when the substrate is located at the implementation position, the engagement section is released from the edge portion of the substrate and returns to the engagement position.

In order to release the substrate implemented in the edge connector, the release lever is manipulated. Since the release lever integrally formed with the housing is engaged with the engagement member, as the release lever is opened outward in the right or left direction, the engagement member moves from the engagement position to the release position. At this time, the engagement member abuts to the stopper integrally formed with the housing, so as to be securely stopped at the release position. Thus, according to the abutting with the stopper, an operator can clearly judge whether the engagement member is located at the release position or not, whereby the substrate in the edge connector can easily be replaced. Also, since the stopper abuts to the release lever engaged with the engagement member, the latter is prevented from unnecessarily opening outward beyond its tolerable range and thereby damaging the lock means of the edge connector.

When the engagement member abutting to the stopper is located at the release position, the engagement member and the substrate are released from engaging each other, whereby the substrate is released from the lock means. The substrate released from being engaged and held returns to the raised position due to the resilient forces of the contacts. In this state, the substrate can easily be replaced.

Further scope of applicability of the present invention will come apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention wherein.

DESCRIPTION OF THE PREFERRED EMBODIMENTS

Figure 1:
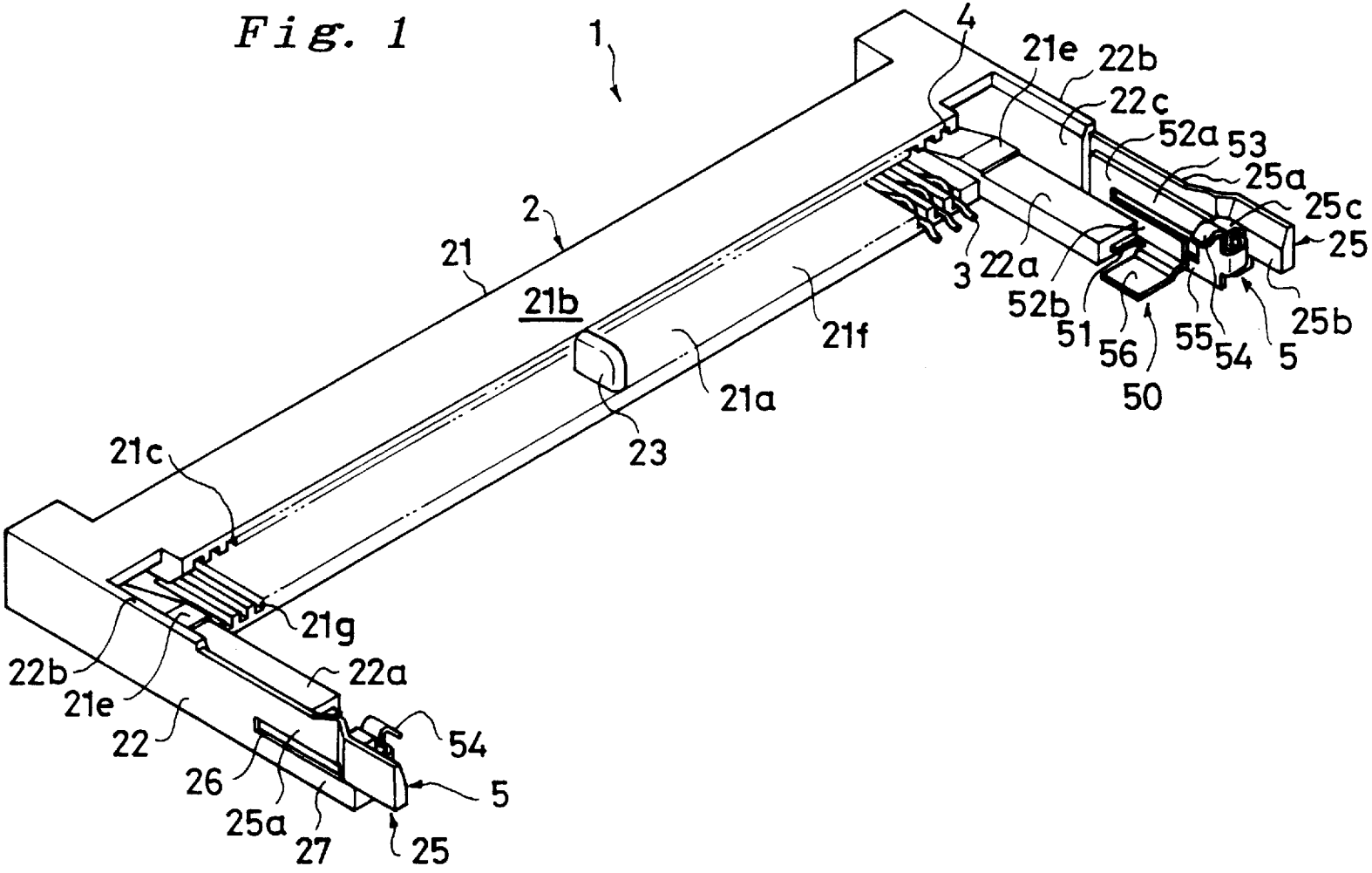
FIG. 1 is a perspective view of an edge connector in accordance with the present invention.

FIG. 1 shows an example of the edge connector in accordance with the present invention. This edge connector 1 comprises a housing 2 integrally formed by an insulating material such as resin, contacts (lower contacts 3 and upper contacts 4) held by this housing 2, and lock mechanisms 5 respectively attached to the right and left sides of the housing 2.

The housing 2 is constituted by a main body 21 extending in the right and left directions, and arms 22 respectively extending rearward (toward the front side in FIG. 1) from the right and left end portions of the main body 21. In the main body 21, a substrate-accommodating groove (accommodating space) 21*a* is formed so as to extend in the right and left directions of the main body 21 and open to the rear side. On the lower face of an upper wall 21*b* of this substrate-accommodating groove 21*a*, a number of upper contact-accommodating grooves 21*c* each extending in the forward and rearward directions are formed so as to align in parallel with the right and left directions.

Also, on the upper face of the rear portion in each of right and left ends of a lower wall 21*d* of the substrate-accommodating groove 21*a*, a tilted substrate-mounting surface 21*e* is formed. Between the right and left substrate-mounting surfaces 21*e*, a contact-arranging surface 21*f* is formed one step lower than the substrate-mounting surfaces 21*e*. In the contact-arranging surface 21*f*, a number of lower contact-accommodating grooves 21*g* each extending in the forward and rearward directions are formed so as to align in parallel with the right and left directions. Here, the upper and lower contact-accommodating grooves 21*c* and 21*g* are positioned in a staggered arrangement with respect to each other.

Further, in order to position the edge connector 1 with respect to another substrate (not depicted) such as a main board of a computer to which the edge connector 1 is to be attached, two pieces of bosses (not depicted) separated from each other by a predetermined distance in the right and left directions are formed on the bottom face of the housing 2.

Each arm 22 is constituted by an inner section 22*a*, which projects to the inside of the edge connector 1 with a width identical to that of the substrate-mounting surface 21*e* while having a height shorter than the substrate-mounting surface 21*e*, and an outer section 22*b*, which is positioned outside of the edge connector 1 and has a height identical to that of the upper face of the upper wall 21*b*. The inner section 22*a* has, at its rear end portion, a slit 22*s* opening rearward and outward for receiving a latch member 50, thereby extending rearward longer than the outer section 22*b*. In order to reduce the space occupied by the edge connector 1, the outer section 22*b* is formed thinner in the right and left directions. An inner wall face 22*c* of the outer section 22*b* is chamfered so as to make it easier to receive a memory module substrate, which will be explained later, into the edge connector 1.

Formed at the inner center portion of the main body 21 is a block-like voltage key 23 with a rounded outer side. This voltage key 23 is security means for blocking a substrate having a different voltage level from being inserted into the edge connector 1, when various kinds of memory module substrates are to be inserted therein. According to the position, thickness, or the like of the voltage key 23 in the right and left directions, various types of memory module substrates can be restrained from being inserted.

Figure 3:
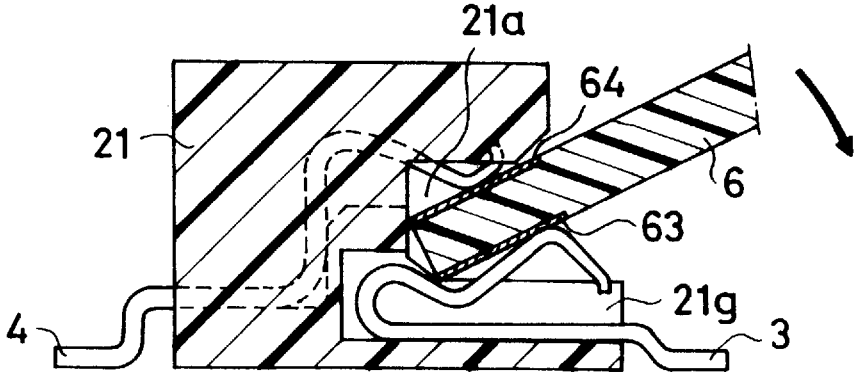
FIG. 3 is a cross-sectional view showing a relationship between contacts and the memory module inserted into the above-mentioned accommodating groove.

As shown in FIG. 3, the lower contact 3 formed like "β" from the conductive material is pushed into the lower contact-accommodating groove 21*g* from the rear side, whereby its base portion is held within the accommodating groove 21*g*, whereas its tip portion projects into the substrate-accommodating groove 21*a*. In substantially the same manner, the hook-shaped upper contact 4 is pushed into the upper-contact accommodating groove 21*c* from the front side, whereby its base portion is held within the accommodating groove 21*c*, whereas the tip portion projects into the substrate-accommodating groove 21*a*.

In each of the lower and upper contacts 3 and 4, the base portion is made thicker than the tip portion. Also, in each of the lower and upper contact-accommodating grooves 21*g* and 21*c*, the lower portion, i.e., portion for accommodating the contact base portion, is formed somewhat wider than the upper portion. Accordingly, after the lower and upper contacts 3 and 4 are pushed in, only their base portions are firmly held by the lower portions of the accommodating grooves. Therefore, even when repeatedly coming into contact with the memory module, the base portions of the contacts 3 and 4 are prevented from shifting their positions, whereas their tip portions can deform elastically.

Figure 5A:
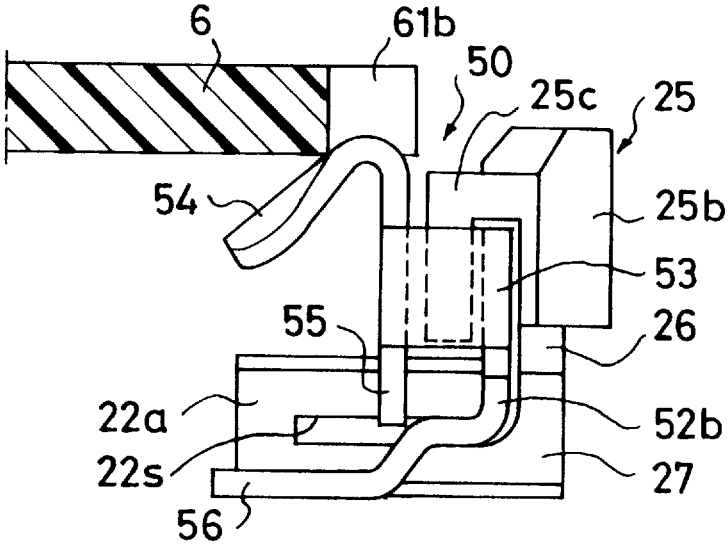
FIGS. 5A to 5C are rear views of a right arm of the housing for representing operations of a lock mechanism of the above-mentioned edge connector, respectively showing a state where the memory module begins to abut to an engagement section, a state where a latch member and a release lever move to a release position as the memory module is pushed down, and a state where the release lever is opened.
Figure 5B:
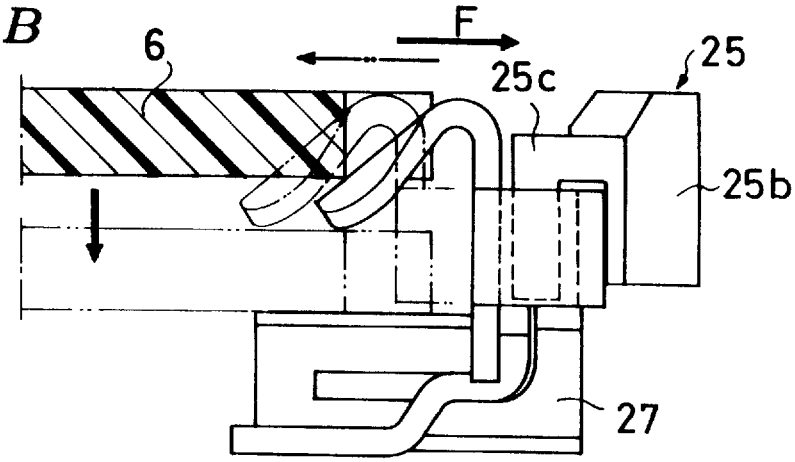
Figure 5C:
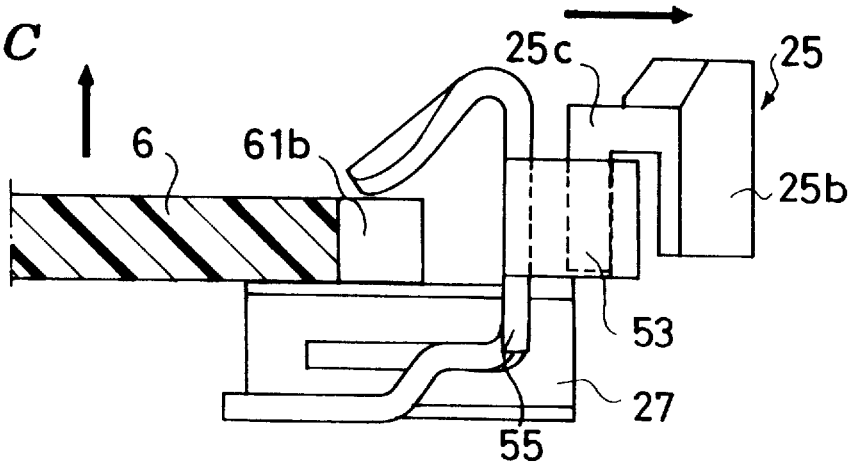
Figure 6A:
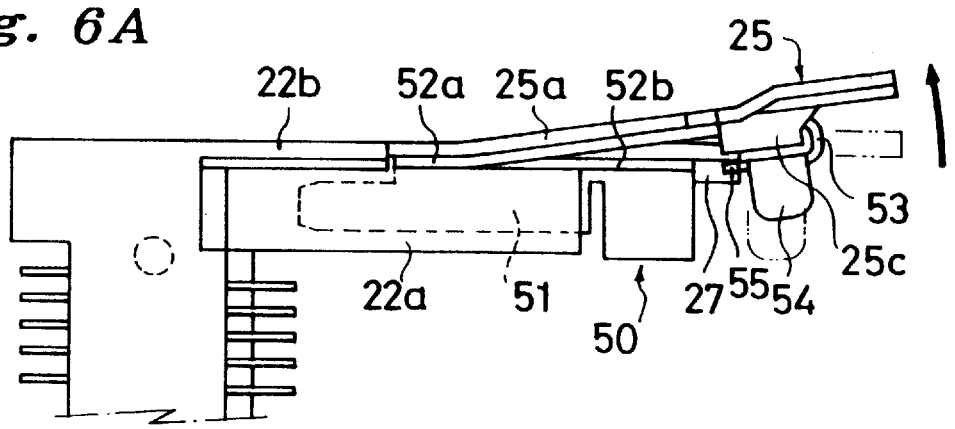
FIG. 6A is a top plan view of the above-mentioned edge connector.
Figure 6A:
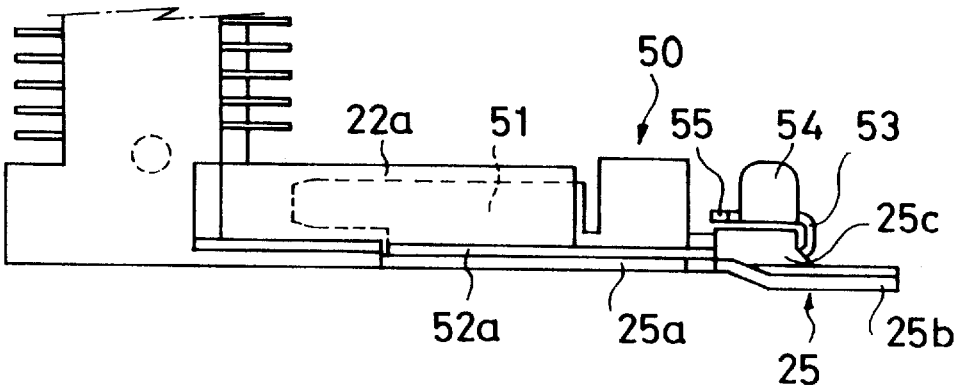
Figure 6B:
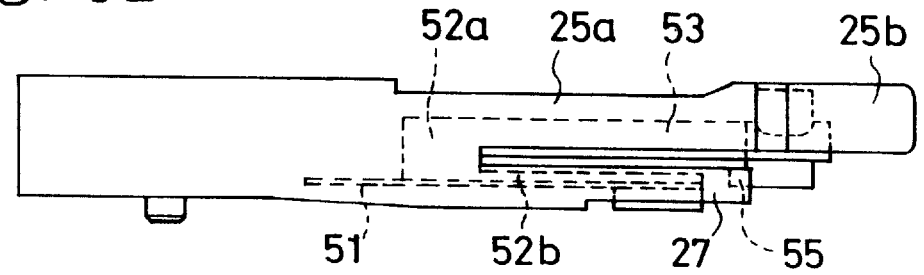
FIG. 6B is a side view of the above-mentioned edge connector.

In the following, the lock mechanism 5 will be explained further with reference to FIGS. 5A to 5C and 6A and 6B. Here, for the convenience of explanation, FIGS. 5A to 5C show only the parts near the rear end portion of the arm 22.

The lock mechanism 5 is constituted by a release lever 25 integrally formed with the arm 22 of the housing 2 by the resin and the latch member 50 made of a metal material separately from the arm 22.

The release lever 25 is constituted by a side plate spring section 25*a* smoothly extending from the rear end of the outer section 22*b* of the arm 22 while having a height and thickness smaller than that of the outer section 22*b* with an outer side face coinciding therewith; an operating section 25*b* extending from the tip portion of the side plate spring section 25*a* obliquely outward and rearward and then in parallel with the arm 22 again; and a hook section 25*c* extending from the operating section 25*b* horizontally to the inside of the edge connector 1 and then descending. Here, since the side plate spring section 25*a* has a height greater than the width, it can easily deform in the right or left direction.

Formed below the side plate spring section 25*a* is a stopper 27 extending along the side plate spring section 25*a*. Near the outer section 22*b*, the stopper 27 is integral with the side plate spring section 25*a* and has a substantially L-shaped cross section with the internal angle of the "L" directed to the inside of the edge connector 1. A slit 26 horizontally cutting through the arm 22 from the rear side vertically divides the "L" into two so as to be separated from the side plate spring section 25*a*. Accordingly, the side plate spring section 25*a* can swing rightward and leftward with the front end of the slit 26 acting as its supporting point.

Positioned inside of the front portions of the side plate spring section 25*a* and stopper 27 is the inner section 22*a* of the arm 22. In the gap between the inner section 22*a* and the side plate spring section 25*a* and stopper 27, the latch member 50, which will be explained later, is inserted. A press-fit section 51 of the latch member 50 is pressed into the horizontal slit 22*s* formed inside of the inner section 22*a*.

The latch member 50 is formed by a planar material made of brass, copper, iron, their alloys, or the like, and is subjected to solder plating or the like.

The latch member 50 is constituted by the press-fit section 51, an upper support section 52*a*, a lower support section 52*b*, a side plate spring section 53, an engagement section (engagement member) 54, an abutment section 55, and an attachment base section 56. The press-fit section 51, which is pressed into the arm 22 of the housing 2 in order to attach the latch member 50 to the arm 22, horizontally extends forward at the front portion of the latch member 50. The upper support section 52*a* is vertically bent upward from the rear outer end of the press-fit section 51 so as to extend upward. From the upper rear end of the upper support section 52*a*, the side plate spring section 53 extends rearward. Also, the lower support section 52*b* is bent upward from the rear outer end of the press-fit section 51 so as to extend rearward. The attachment base section 56 extends from the lower support section 52*b* in parallel with the press-fit section 51 toward the inside at a position lower than the press-fit section 51. By way of the attachment base section 56, the edge connector 1 is mounted on the main board to which the edge connector 1 is to be soldered.

Further, the side plate spring section 53 of the latch member 50 is formed as a U-shaped band when viewed from the top face, extending rearward from the upper support section 52*a* and then returning to the front side. The portion extending from the inner end of the side plate spring section 53 upward and then obliquely inward and downward so as to form an inverted hook is the engagement section (engagement member) 54. The abutment section 55 is formed so as to extend downward from the inner end of the side plate spring section 53 in the direction opposite to the engagement section 54 and project forward.

A pair of the right and left latch members 50 are formed symmetrically to each other and then respectively pushed into the inner portions 22*a* of the two arms 22 of the housing 2. At the time of this press-fitting operation, the latch member 50 is pushed in such that the side plate spring section 53 engages the inside of the hook section 25*c* of the release lever 25. Here, the upper outer edge of the slit 22*s*, which is formed in the inside of the inner section 22*a* so as to open outward and rearward, and the inner face of the stopper 27 are appropriately rounded such that the latch member 50, which is bent inward and upward, can easily enter therein.

The lock mechanism 5 thus attached to the rear end portion of the arm 22 can freely swing in the right and left directions between a position (referred to as "engagement position" hereinafter) shown in FIG. 5A where the tip portion of the engagement section 54 protrudes inward to the position substantially the same as the inner side face of the inner portion 22*a* of the arm 22 in the state where no force in the right and left directions acts on the side plate spring section 25*a* of the release lever 25 and the side plate spring section 53 of the latch member 50 and a position (referred to as "release position" hereinafter) shown in FIG. 5C where, as an operator opens the release lever 25 outward, the tip portion of the engagement section 54 shifts outward such that the abutment section 55 of the latch member 50 abuts to the stopper 27. The lock mechanism 5 at the release position is always urged toward the engagement position by the resilient force of each of the plate spring sections 25*a* and 53.

Figure 8:
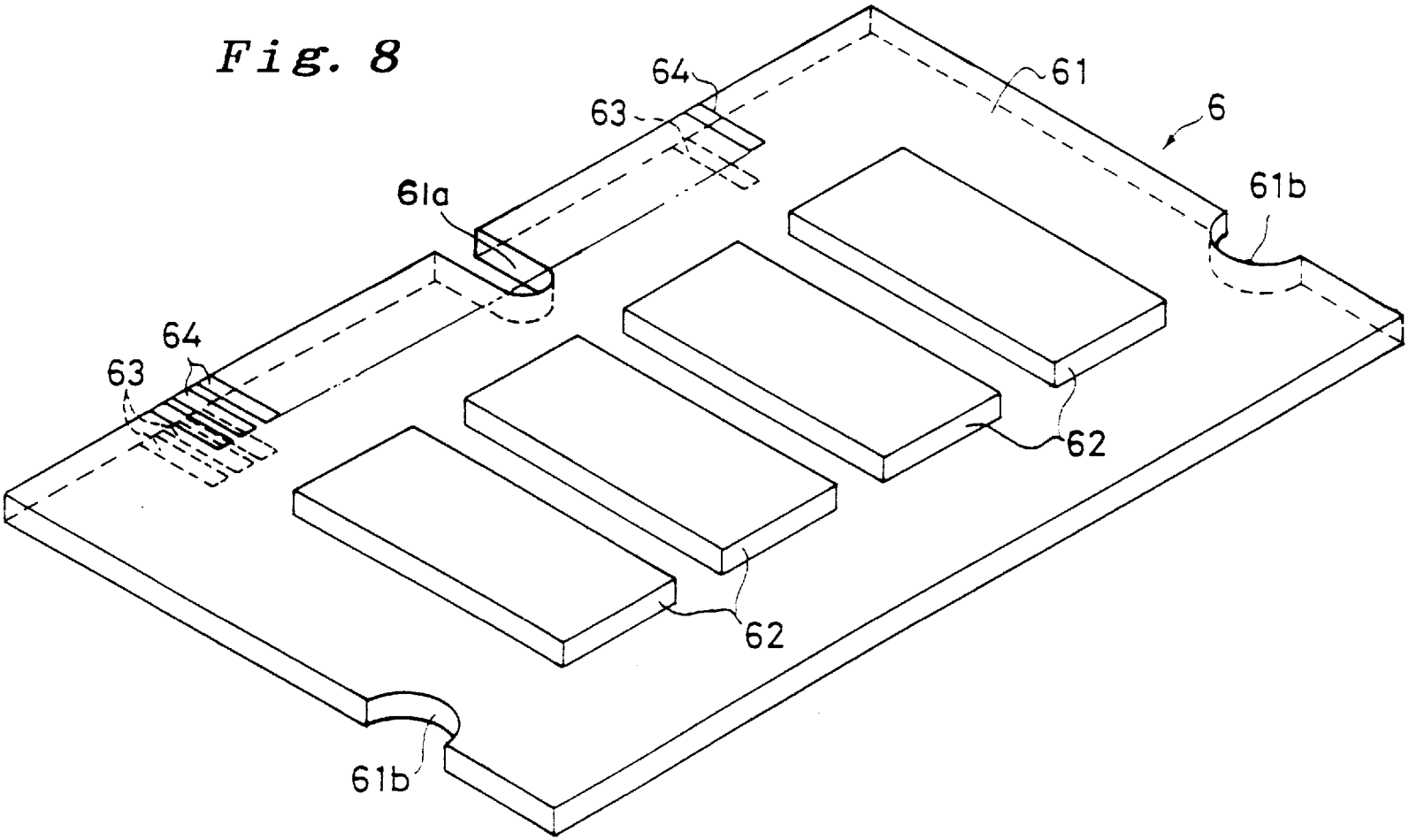
FIG. 8 is a perspective view of the memory module.

To thus configured edge connector 1, a memory module 6 shown in FIG. 8 is detachably attached. The memory module 6 is constituted by a card-shaped module substrate 61 and a plurality of memory chips 62 attached onto this substrate 61. Respectively formed on the upper and lower faces at the front end thereof are a plurality of conductive pads 63 and a plurality of conductive pads 64, which are connected to the memory chips 62 by way of lead patterns printed on the memory module substrate 61.

Formed at the center of the front end portion of the module substrate 61 is a U-shaped notch 61*a*. This notch 61*a* mates with the above-mentioned voltage key 23 when the memory module 6 is inserted into the edge connector 1. When the position and size of the notch 61*a* is changed together with that of the voltage key 23 for various kinds of edge connectors, the memory module 6 with a different voltage level or the reversed memory module 6 can be prevented from being accidentally inserted into the edge connectors.

Further formed on the rear side in each of the right and left end portions of the memory module substrate 61 is a positioning indent 61*b* which is cut out semicircularly. This positioning indent 61*b* functions to keep the position of the memory module 6 constant with respect to the edge connector 1, thereby preventing the substrate from being incompletely inserted into the edge connector 1.

Figure 2:
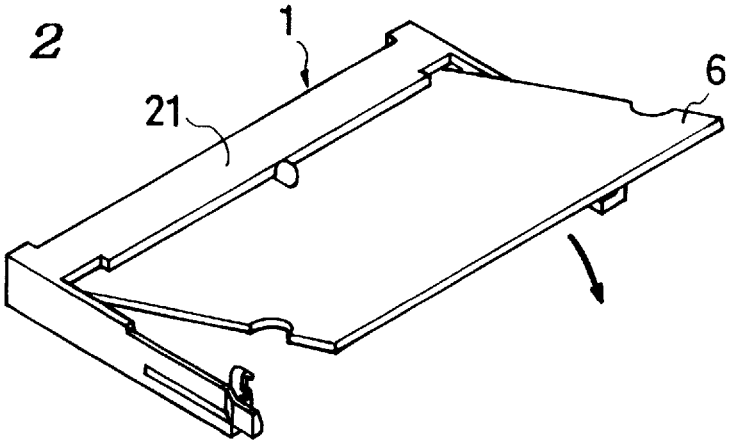
FIG. 2 is a perspective view showing a state of a memory module inserted into an accommodating groove of a main body of a housing in this edge connector.

In the following, operations for attaching/detaching the memory module 6 to/from the edge connector 1 will be explained. In order to attach the memory module 6 to the edge connector 1, first, the memory module 6 is held by a hand and, as shown in FIGS. 2 and 3, the front end portion of the memory module 6 is inserted into the substrate-accommodating groove 21*a* of the main body 21 of the housing 2 from obliquely thereabove. Here, the voltage key 23 of the edge connector 1 is inserted into the notch 61*a* of the memory module 6. It indicates that the memory module 6 having an appropriate voltage level with respect to the main board provided with the edge connector 1 is inserted into the edge connector 1 with its correct orientation.

At this moment, as shown in FIG. 3, the tip portion of the lower contact 3 comes into contact with the conductive pad 63 on the lower side of the memory module 6 at the front portion, whereas the tip portion of the upper contact 4 comes into contact with the conductive pad 64 on the upper side. Due to the resilient forces generated by the elasticity of the lower and upper contacts 3 and 4, the memory module 6 is held at the raised position where its rear portion is positioned above the arms 22 of the edge connector 1.

Next, against the resilient forces of the lower and upper contacts 3 and 4, the memory module 6 is pushed down from the raised position to the implementation position where the memory module 6 is in parallel with the arms 22 of the edge connector 1. Here, as shown in FIG. 5A, the lower edge portion of the positioning indent 61*b* of the memory module 6 abuts to the upper face of the engagement section 54 located at the engagement position.

As shown in FIG. 5B, since the upper face of the engagement section 54 is tilted inwardly downward, the engagement section 54 receives a force F in the right or left direction, whereby the side plate spring section 53 having the engagement section 54 moves toward the release position. Accordingly, as the memory module 6 is pushed down, at the inner lower edge portion of the positioning indent 61*b*, it moves the engagement section 54 toward the release position while sliding on the upper face of the engagement section 54. Here, since the release lever 25 is engaged with the side plate spring section 53 by the hook section 25*c* of the release lever 25, it moves outward together with the side plate spring section 53.

When the memory module 6 pushes and opens the engagement section 54 and moves below the engagement section 54 such that the lower face of the memory module substrate 61 abuts to the substrate-mounting surfaces 21*e* formed at both ends of the main body 22 of the housing 2 so as to be positioned in parallel with the inner sections 22*a* of the arms 22, i.e., when the memory module substrate 61 reaches the implementation position, the lower end of the engagement section 54 is released from the upper edge portion of the positioning indent 61*b*. Consequently, as indicated by imaginary lines in FIG. 5B, due to the resilient forces of the side plate spring section 53 of the latch member 50 and the side plate spring section 25*a* of the release lever 25, the engagement section 54 is pushed up above the memory module substrate 61, which has reached the implementation position, and returns to the engagement position.

Figure 4:
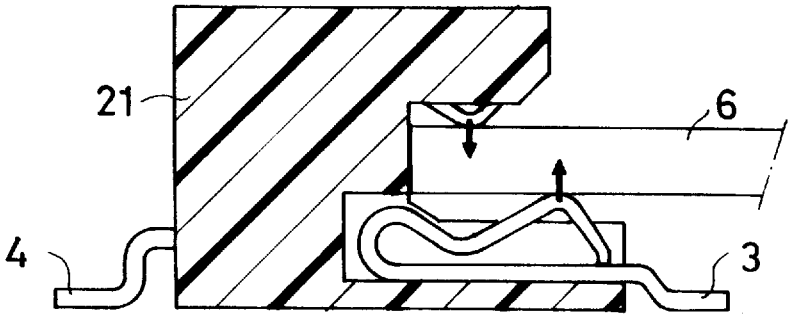
FIG. 4 is a cross-sectional view showing a state where the above-mentioned memory module is pushed down.

In this implementation position, the memory module 6 is urged the raised position by the lower and upper contacts 3 and 4 as shown in FIG. 4. Since the upper face of the memory module substrate 61 is in contact with the lower face of the engagement section 54, however, the memory module 6 is held within the edge connector 1 without rising. In the implementation position, the lower and upper contacts 3 and 4 and their corresponding conductive pads 63 and 64 of the memory module substrate 61 are held in the press contact state. Accordingly, the memory module 6 is securely electrically connected, by way of the edge connector 1, to the main board (not depicted) to which the base sections of the lower and upper contacts 3 and 4 of the edge connector 1 are soldered.

Figure 7A:
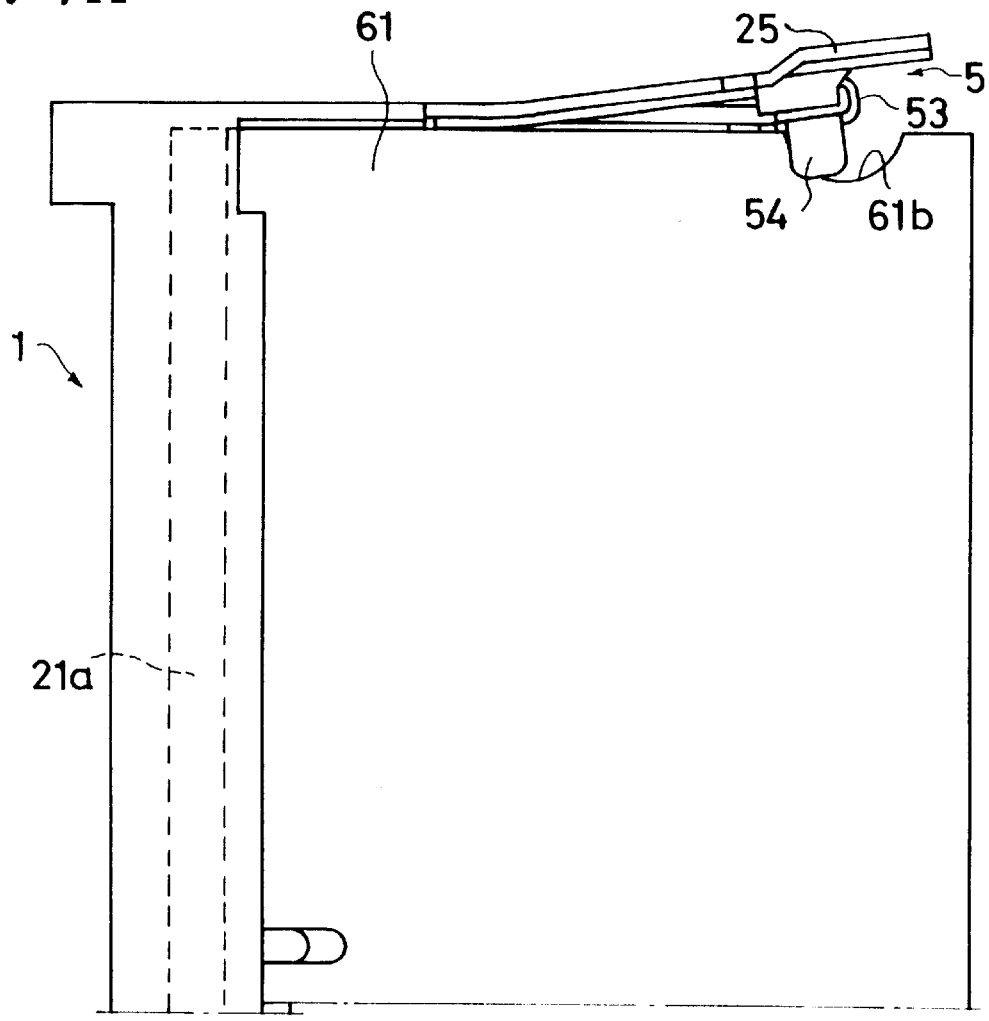
FIG. 7A is a top plan view of the above-mentioned edge connector in which the memory module is insufficiently inserted therein.
Figure 7B:
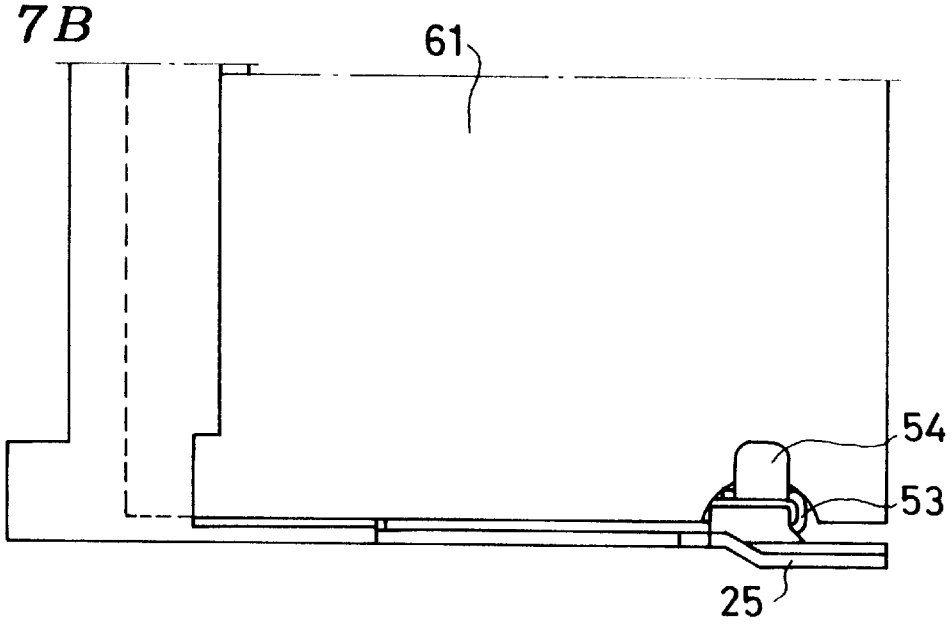
FIG. 7B is a top plan view of the above-mentioned edge connector in which the memory module is correctly inserted therein.

Further, in the implementation position, as shown in FIG. 7B, the inner portion of the plate spring section 53 returned to the engagement position by the resilient force is received within the positioning indent 61*b* of the memory module substrate 61 as its front end and rear end, i.e., portion bent forward, abut to the inner face of the positioning indent 61*b*. Accordingly, the memory module 6 is firmly secured and held within the edge connector 1 in its forward and rearward directions as well.

As shown in FIG. 7A, if the memory module 6 is not fully inserted into the accommodating groove 21*a*, the inner portion of the side plate spring section 53 will not be accommodated in the positioning indent 61*b*. In this state, the memory module 6 is not firmly held in the forward and rearward directions even when engaged with the engagement section 54 in the upward and downward directions. Accordingly, there is a possibility that the memory module 6 may drop out of the edge connector 1 under the influence of vibration or the like. In this case, however, the release lever 25 projects rightward or leftward, whereby the operator can easily recognize the incomplete attachment of the memory module. Thus, security is enhanced.

In order to remove the memory module 6 held at the implementation position from the edge connector 1, the operator opens the operating section 25*b* of each of the right and left release levers 25 outward as shown in FIG. 5C. When the release lever 25 is opened, the side plate spring section 53 inserted into the hook section 25*c* of the release lever 25 moves outward together with the release lever 25. When the engagement section 54 positioned at the inner upper end portion of the side plate spring section 53 reaches the release position, the tip portion of the engagement section 54 leaves the upper face of the memory module substrate 61 and enters the positioning indent 61*b*. Consequently, the memory module 6 urged toward the raised position by the resilient forces of the lower and upper contacts 3 and 4 is tilted up with its front edge portion acting as the supporting point.

In the case where the operator attempts to open the release lever 25 rightward or leftward beyond the release position here, the abutment section 55 positioned at the inner lower end portion of the side plate spring section 53 abuts to the inner side face of the stopper 27, which is integrally formed with the housing 2 and positioned at the outer lower rear end portion of the arm 22. Accordingly, the release lever 25 is prevented from opening more than necessary. Also, since the abutment section 55 and the stopper 27 abut to each other when removing the memory module 6, the operator can safely move the release lever 25 to the abutment position.

Thereafter, it is only necessary for the operator to pull out the memory module 6, which has been moved to the raised position, from the edge connector 1 by fingers.

When thus configured edge connector 1 is used, the memory module 6 can be attached thereto easily and securely as simply being inserted therein and pushed down. Also, as the voltage key 23 disposed near the center of the accommodating groove 21*a* prevents memory modules with a wrong voltage level from being inserted therein, the edge connector 1 is excellent in safety.

The edge connector 1 is also excellent in its performance of securing and holding. When the memory module 6 is pushed down to the implementation position after insertion, it is secured in the right and left directions as both side edge portions of the memory module substrate 61 are fitted into the respective outer side sections 22*b* of the arms 22, it is secured in the upward and downward directions as the upper face of the memory module substrate 61 is engaged with the engagement section 54 of the latch member 50, and it is secured in the forward and rearward directions as the positioning indent 61*b* of the memory module substrate 61 accommodates the inner portion of the side plate spring section 53. Thus, the edge connector 1 firmly secures and holds the memory module 6 in a three-dimensional manner thereby attaining a security against vibration or the like.

Further, the edge connector 1 is advantageous in terms of space saving. The space occupied by the edge connector should be as little as possible, in particular, when it is connected to a motherboard (main board) of a computer or the like. In the edge connector 1, since the lock mechanism 5 disposed at the arm 22 is constituted by the release lever 25 integrally formed with the housing 2 by a resin and the latch member 50 formed of a metal material, the engagement section 54 exhibits a sufficient durability even when the memory module 6 is repeatedly attached thereto and detached therefrom. Also, since the arms 22 are made thinner in the right and left directions, the edge connector 1 occupies only a small space in the main board to which it is attached.

Further, the edge connector 1 is advantageous in that the memory module 6 can easily be removed therefrom and in that it is excellent in safety. Since the rear portion of the memory module 6 jumps up when the release levers 25 are simply opened rightward and leftward, it is sufficient for the operator to simply pull out the memory module 6. Also, since the abutment section 55 abuts to the stopper 27 when the lock mechanism 5 is opened to the release position by the release lever 25, the release position is clear to the operator. Accordingly, the operator can safely remove the memory module 6, thereby yielding a favorable operability. Also, since the stopper 27 prevents the release lever 25 from opening more than necessary, the lock mechanism 5 is kept from being damaged, whereby excellent safety and durability can be obtained.

Though the stopper 27 in the foregoing embodiment is formed so as to extend along the outer lower portion of the arm 22 of the housing 2, its position and form in the edge connector of the present invention should not be restricted thereto. For example, the inner section 22*a* of the arm 22 may be extended rearward so as to function as a stopper as well.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This application claims the priority of Japanese Patent Application No. 8-109560 filed on Apr. 30, 1996, which is incorporated herein by reference.

What is claimed is:

1. An edge connector comprising:

a housing formed by a resin material, said housing having a main body, and arms respectively extending rearward from right and left ends of the main body, said main body having an accommodating space which is adapted to accommodate a front end portion of a substrate;

a plurality of contacts arranged within said accommodating space, said contacts abutting to conductive pads formed at the front end portion of said substrate while said front end portion is accommodated in said accommodating space; and lock means attached to said arms, said lock means securing and holding said substrate at an implementation position where said front end portion is accommodated in said accommodating space and extends along said arms;

wherein said substrate is pushed down from a raised position where the front end portion of said substrate is inserted into said accommodating space while a rear portion of said substrate is tilted up with respect to said arms to said implementation position where said substrate extends along said arms so that said substrate is attached to said edge connector; and wherein said lock means comprises:

an engagement member made of a metal material and attached to said housing, said engagement member being movable between an engagement position for engaging and holding said substrate positioned at said implementation position and a release position for releasing said substrate from being engaged and held;

a release lever integrally formed with said housing by the resin material so as to be able to engage said engagement member, said release lever moving said engagement member from said engagement position to said release position when opened outward in the right or left direction; and a stopper integrally formed with said housing, said stopper abutting to said engagement member when said engagement member moves to said release position so as to prevent said engagement member from moving beyond said release position.

2. An edge connector according to claim 1, wherein a voltage key is disposed within the accommodating space of said main body, while a notch adapted to accommodate said voltage key is formed at the front end portion of said substrate, the front end of said substrate being adapted to be accommodated within said accommodating space in a state where said voltage key is accommodated in said notch.

3. An edge connector according to claim 1, wherein said plurality of contacts are disposed within said accommodating space so as to vertically oppose to each other;

wherein the front end portion of said substrate is weakly held between said contacts from thereon and thereunder in a state where the front end portion of said substrate is inserted into said accommodating space such that said substrate is located at said raised position; and wherein, as said substrate is pushed down to said implementation position, a tip of said substrate elastically deforms said contacts so that the conductive pads of said substrate and said contacts are brought into contact with each other as pressed by thus yielded elastic force.

4. An edge connector according to claim 3, wherein said substrate positioned at said implementation position receives a force toward said raised position by the elastic force of said contacts; and wherein, when said release lever is operated so as to move said engagement member to said release position and release said substrate from being engaged and held by said engagement member, said substrate moves to said raised position due to the elastic force of said contacts.

5. An edge connector according to claim 1, wherein said engagement member has an upper face tilted downward and inward, said engagement member opening wide to elastically deform from said engagement position to said release position when a side portion of said substrate abuts thereto as said substrate is pushed down from said raised position to said implementation position; and wherein, in a state where said substrate is pushed down to said implementation position, a side edge portion of said substrate is positioned lower than said engagement member so as to be released from abutting to said engagement member, whereby said engagement member moves back to said engagement position by an elastic resilient force so as to be positioned higher than the side portion of said substrate and prevent said substrate from moving to said raised position.

6. An edge connector according to claim 1, wherein an inwardly recessed positioning indent is formed in a side portion of said substrate, said engagement member being engaged with said substrate at said positioning indent so that said substrate is engaged and held at said implementation position.

* * * * *